US006130030A

United States Patent [19]

Anderson et al.

[11] Patent Number: 6,130,030

[45] Date of Patent: Oct. 10, 2000

[54] PHOTOGRAPHIC ELEMENT HAVING A STAIN RESISTANT PROTECTIVE OVERCOAT

[75] Inventors: Charles C. Anderson, Penfield; Brian A. Schell, Honeoye Falls, both of N.Y.

[73] Assignee: Eastman Kodak Company, Rochester, N.Y.

[21] Appl. No.: 09/273,644

[22] Filed: Mar. 23, 1999

[51] Int. Cl.[7] ..... G03C 1/85; G03C 1/89; G03C 1/77; G03C 1/76

[52] U.S. Cl. ..... 430/525; 430/527; 430/529; 430/530; 430/531

[58] Field of Search ..... 430/527, 530, 430/529, 535, 531, 528, 525, 536

[56] References Cited

U.S. PATENT DOCUMENTS

| | | | |
|---|---|---|---|
| Re. 34,348 | 8/1993 | Heilmann et al. | 526/245 |
| 3,574,791 | 4/1971 | Sherman et al. . | |
| 3,728,151 | 4/1973 | Sherman et al. . | |
| 4,579,924 | 4/1986 | Schwartz et al. | 526/243 |
| 5,350,795 | 9/1994 | Smith et al. | 524/507 |
| 5,607,663 | 3/1997 | Rozzi et al. | 424/49 |
| 5,662,887 | 9/1997 | Rozzi et al. | 424/49 |
| 5,786,134 | 7/1998 | Nair et al. | 430/527 |
| 5,962,207 | 10/1999 | Anderson et al. | 430/527 |

FOREIGN PATENT DOCUMENTS

| | | |
|---|---|---|
| 0 845 090 | 11/1987 | European Pat. Off. . |
| 0 118 080 | 5/1997 | European Pat. Off. . |
| 0 884 636 | 12/1998 | European Pat. Off. . |

*Primary Examiner*—Richard L. Schilling
*Attorney, Agent, or Firm*—Doreen M. Wells

[57] ABSTRACT

The present invention is a photographic element having a support, at least one silver halide emulsion layer superposed on the support, at least one electrically conductive layer superposed on the support and a protective overcoat superposed on the support. The electrically conductive layer is composed of an electrically conductive agent and a binder. The protective overcoat includes a polyurethane having a tensile elongation to break of at least 50% and a Young's modulus measured at 2% elongation of at least 50,000 lb/in$^2$ and an interpolymer comprising repeating units of A and B wherein A comprises a fluorine containing acrylate or a fluorine containing methacrylate monomer and B comprises an ethylenically unsaturated monomer containing hydratable groups.

14 Claims, No Drawings

PHOTOGRAPHIC ELEMENT HAVING A STAIN RESISTANT PROTECTIVE OVERCOAT

CROSS REFERENCE TO RELATED APPLICATIONS

This application relates to commonly assigned copending application Ser. No. 09/274,644, filed simultaneously herewith and hereby incorporated by reference for all that it discloses.

FIELD OF THE INVENTION

The present invention relates to an improved photographic element, and more particularly to a photographic element that resists tar adsorption and stain absorption.

BACKGROUND OF THE INVENTION

In the photographic industry the need to protect an imaging element from dirt and dust, scratches and abrasion, and deposition of stains has long been recognized. Significant progress has been made in the prevention of dirt and dust attraction through the use of antistatic layers in imaging elements. Improved protective overcoats have reduced the propensity for imaging elements to be scratched or abraded during manufacture and use. However, there is still a need to improve the stain resistance of imaging elements.

The treatment of articles such as textiles and food containers with soil and stain resistant compositions is well known. For example, U.S. Pat. Nos. 3,574,791 and 3,728,151 disclose block or graft copolymers which have two different segments, one of which is highly fluorinated and oleophobic and the other of which is hydrophilic. U.S. Pat. No. 4,579,924 describes fluorochemical copolymers useful as paper making additives which impart oil and water repellancy and food stain resistance to ovenable paperboard food containers. U.S. Pat. No. 5,350,795 describes aqueous and oil repellent compositions which cure at ambient temperature. The compositions comprise an aqueous solution or dispersion of a fluorochemical acrylate copolymer and a polyalkoxylated polyurethane having pendant perfluoroalkyl groups. U.S. Pat. No. Re. 34,348 discloses stain resistant compositions containing fluorinated polymers derived from acrylamide-functional monomers. Fluorocarbon containing coatings for hard tissue and surfaces of the oral environment that reduce staining and adhesion of bacteria and proteinaceous substances are described in U.S. Pat. Nos. 5,662,887 and 5,607,663.

U.S. Pat. No. 4,229,524 describes copolymers containing perfluoroalkyl groups which can be used in a layer of a photosensitive material to improve antistatic and adhesion properties of the layer.

For a photographic element the requirements for a stain resistant overcoat are rather unique. The stain resistant layer must not effect the transparency, color, or other imaging properties of the film. The application and curing of the stain resistant coating must be compatible with the photographic element manufacturing process. The overcoat layer must be able to provide stain resistance when applied as a submicron-thick layer. In addition, the stain resistant overcoat should have excellent physical properties including resistance to scratch, abrasion, ferrotyping and blocking.

A wide variety of substances may adsorb onto or absorb into either the front or back surface of photographic elements and cause a permanent stain that degrades image quality. The deposition of these stain causing substances onto a photographic element may occur in many different ways. For example, dirt, fingerprints, and grease may be deposited onto the photographic element during handling. A photographic element may be stained when it comes in contact with a dirty surface or as a result of an accidental spill from, for example, a liquid drink such as coffee or soda. Other stains may be deposited onto a wet photographic element during film processing. For example, a tar-like material which is derived mostly from polymeric oxidized developer and which may be present at the surface of or on the walls of film processing solution tanks may be deposited during film processing. This tar may adhere to or diffuse into the surface layer of the photographic element and cause an extremely difficult to remove, brown-colored stain.

Film processor tar deposits and stain have been a particular problem with some protective overcoats used on motion picture film. In U.S. Pat. No. 5,786,134 and copending commonly-assigned U.S. Ser. No 09/018,867, now U.S. Pat. No. 5,962,207, and U.S. Ser. No. 09/090,827 are described improved motion picture films that resist tar pickup. In these patent applications, the backside of the films contain a stain resistant layer applied over the protective overcoat. The present invention relates to eliminating tar pickup during processing by providing a new protective overcoat. This protective overcoat is obtained by the coating and subsequent drying of a coating composition containing a polyurethane and an interpolymer containing at least two different segments; one of which is fluorinated and therefore oleophobic, the other of which is hydratable. Thus, in the present invention, stains such as tar deposits are eliminated without the need to coat the additional layer of the prior art. Further, the stain resistant protective overcoat of the invention does not degrade the transparency, frictional characteristics, or other physical properties of the photographic element, and may be applied from solvent or aqueous media at low cost.

SUMMARY OF THE INVENTION

The present invention is a photographic element having a support, at least one silver halide emulsion layer superposed on the support, at least one electrically conductive layer superposed on the support and a protective overcoat superposed on the support. The electrically conductive layer is composed of an electrically conductive agent and a binder. The protective overcoat includes a polyurethane having a tensile elongation to break of at least 50% and a Young's modulus measured at 2% elongation of at least 50,000 lb/in$^2$ and an interpolymer comprising repeating units of A and B wherein A comprises a fluorine containing acrylate or a fluorine containing methacrylate monomer and B comprises an ethylenically unsaturated monomer containing hydratable groups.

DETAILED DESCRIPTION OF THE INVENTION

In accordance with the present invention there is provided a photographic element containing a polymeric support having on one side thereof, at least one silver halide emulsion layer and on the opposite side thereof, as the outermost layer, a stain resistant protective overcoat; characterized in that said stain resistant protective overcoat includes a polyurethane and a stain resistant interpolymer. Preferably, the polyurethane has a tensile elongation to break of at least 50% and a Young's modulus measured at a 2% elongation of at least 50000 lb/in$^2$. The stain resistant interpolymer has repeating units of A and B wherein A is a fluorine containing acrylate or methacrylate monomer and B is an ethylenically unsaturated monomer containing hydratable groups. The photographic element of the present invention further contains a process surviving, electrically conductive layer. The electrically conductive layer may be present as a conductive subbing layer on either or both sides of the film support or may be present as a conductive overcoat for the at least one silver halide emulsion layer.

The photographic support materials used in the practice of the invention can comprise any of a wide variety of supports. Typical supports include cellulose nitrate film, cellulose acetate film, poly(vinyl acetal) film, polystyrene film, poly (ethylene terephthalate) film, poly(ethylene naphthalate) film, polycarbonate film, glass, metal, paper, polymer-coated paper, and the like. The thickness of the support is not critical. Support thickness of 2 to 10 mils (0.002–0.010 inches) can be employed, for example, with very satisfactory results. To promote adhesion, an undercoat or primer layer is typically employed on polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178; and 3,501,301.

The use of film-forming hydrophilic colloids as binders in photographic elements, including photographic films and photographic papers, is very well known. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar—agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to one or more emulsion layers, the elements of the present invention can contain auxiliary layers conventional in photographic elements, such as overcoat layers, antihalation layers, spacer layers, filter layers, interlayers, pH lowering layers (sometimes referred to as acid layers and neutralizing layers), timing layers, opaque reflecting layers, opaque light-absorbing layers and the like.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 36544, September, 1994, and the references listed therein.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The protective overcoat of the present invention contains a polyurethane and a stain resistant interpolymer. Preferably, the polyurethane is an aliphatic polyurethane. Aliphatic polyurethanes are preferred due to their excellent thermal and UV stability and freedom from yellowing. Preferably, the polyurethanes of the present invention are characterized as those having a tensile elongation to break of at least 50% and a Young's modulus measured at an elongation of 2% of at least 50,000 lb/in$^2$. These physical property requirements help insure that the overcoat layer is hard yet tough to simultaneously provide excellent abrasion resistance and outstanding resiliency.

The polyurethane may be either organic solvent soluble or aqueous dispersible. For environmental reasons, aqueous dispersible polyurethanes are preferred. Preparation of aqueous polyurethane dispersions is well-known in the art and involves chain extending an aqueous dispersion of a prepolymer containing terminal isocyanate groups by reaction with a diamine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion.

The stain resistant interpolymer of the invention is a vinylic interpolymer having repeat units of A and B where A is derived from fluorine-containing acrylate or methacrylate monomers and B is derived from ethylenically unsaturated monomers containing hydratable groups.

More specifically, the unit A is derived from a fluoro (meth)acrylate or mixture of fluoro(meth)acrylates represented by the following formula:

$$(R_f)_pLOCOCR{=}CH_2$$

where the $R_f$ substituent is a monovalent, fluorinated, aliphatic organic radical having at least one carbon atom and as many as 20 carbon atoms, preferably, 2 to 10 carbon atoms. The skeletal chain of $R_f$ can be straight, branched, or cyclic, and can include catenary divalent oxygen atoms or trivalent nitrogen atoms bonded only to carbon atoms. Preferably, $R_f$ is fully fluorinated, but carbon-bonded hydrogen or chlorine atoms can be present as substituents on the skeletal chain of $R_f$. Preferably, $R_f$ contains at least a terminal perfluoromethyl group. Preferably, p is 1 or2.

The linking group L is a bond or hydrocarbyl radical linkage group containing from 1 to 12 carbon atoms and optionally substituted with and/or interrupted with a substituted or unsubstituted heteratom such as O, P, S, N. R is either H or methyl. Preferably, the fluoro(meth)acrylate monomer contains at least 30 weight percent fluorine. Nonlimiting examples of fluoro(meth)acrylates useful in the present invention include:

$$CF_3(CF_2)_x(CH_2)_yOCOCR{=}CH_2$$

where x is 0 to 20, preferably 2 to 10, y is 1 to 10, and R is H or methyl $$HCF_2(CF_2)_x(CH_2)_yOCOCR{=}CH_2$$

where x is 0 to 20, preferably 2 to 10, y is 1 to 10, and R is H or methyl

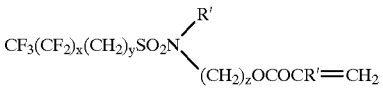

where x is 0 to 20, preferably 2 to 10, y is 1 to 10, z is 1 to 4, R' is alkyl or arylalkyl, and R" is H or methyl

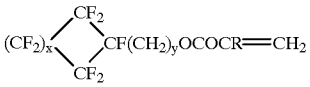

where x is 0 to 7, y is 1 to 10, and R is H or methyl $$CF_3(CF_2CF_2O)_x(CF_2O)_y(CH_2)_zOCOCR{=}CH_2$$

where x+y is at least 1 up to 20, z is 1 to 10, and R is H or methyl.

The B unit is derived from ethylenically unsaturated monomers containing hydratable, ionic or hydratable, nonionic groups or combinations of hydratable ionic and hydratable, nonionic groups. Monomers containing hydratable, ionic groups include mono- or multifunctional carboxyl containing monomers represented by the following formula:

$$CH_2{=}CRL(COOH)_x$$

where R is H, methyl, ethyl, carboxy, carboxymethyl, or cyano, L is a bond or hydrocarbyl radical linkage group containing from 1 to 12 carbon atoms and optionally substituted with and/or interrupted with a substituted or unsubstituted heteratom such as O, P, S, N. X is equal to 1 or 2. This unit may be present in its protonated acid form or salt form after neutralization with an organic or inorganic base.

The B unit may also be derived from ethylenically unsaturated monomers containing sulfonic acid groups, such as vinyl sulfonic acid, styrene sulfonic acid, 2-acrylamido-2-methyl propane sulfonic acid, and the like. Alternatively, the B unit may be derived from ethylenically unsaturated monomers containing phosphorous acid or boron acid groups. These units may be present in their protonated acid form or salt form.

The B unit may be derived from substituted or unsubstituted ammonium monomers such as N,N,N-trialkylammonium methyl styrene, N,N,N-trialkylammonium akyl (meth)acrylate, N,N,N-trialkylammonium (meth)acrylamide, etc., where the counterion may be fluoride, chloride, bromide, acetate, propionate, laurate, palmate, stearate, etc.

The B unit may further be derived from ethylenically unsaturated monomers containing nonionic, hydrophilic groups. Suitable monomers include: mono- or multifunctional hydroxyl containing monomers such as hydroxyalkyl (meth)acrylates and N-hydroxyalkl (meth)acrylamides; poly (oxyalkylene)-containing (meth)acrylates and poly (oxyalkylene)-containing itaconates, (meth)acrylamide, and vinyl pyrrolidone.

Preferably, the monomer containing nonionic, hydrophilic groups is a (meth)acrylate containing a poly(oxyalkylene) group in which the oxyalkylene unit has 2 to 4 carbon atoms, such as —$OCH_2CH_2$—, —$OCH_2CH_2CH_2$—, —$OCH(CH_3)CH_2$—, or —$OCH(CH_3)CH(CH_3)$—. The oxyalkylene units in said poly(oxyalkylene) being the same, as in poly (oxypropylene), or present as a mixture, as in a heteric straight or branched chain of blocks of oxyethylene units and blocks of oxypropylene units. The poly(oxyalkylene) group contains 4 to about 200, preferably, 15 to about 150 oxyalkylene units. A representative example of a poly (oxyalkylene)-containing meth(acrylate) suitable for the purpose of the present invention is represented by the following formula:

$$CH_2{=}CR'COO(CH_2CH_2O)_xR''$$

where R' and R" are independently H or methyl, x is 4 to 200.

The fluoro(meth)acrylate interpolymers of the invention comprise 10 to 90 weight % of units A and 10 to 90 weight % of units B. Minor, non-interfering amounts of monomers other than those described above can also be incorporated into the fluoro(meth)acrylate interpolymers of this invention. For example, the interpolymers of this invention can contain up to about 40 weight percent, and preferably up to about 30 weight percent, of polymer units derived from ethylene, vinyl acetate, vinyl halide, vinylidene halide, acrylonitrile, alkyl (meth)acrylates, methacrylonitrile, glycidyl acrylate, glycidyl methacrylate, styrene, alkyl styrenes, vinylpyridine, vinyl alkyl ethers, vinyl alkyl ketones, butadiene, vinyl silanes, and mixtures thereof.

The fluoro(meth)acrylate interpolymers of the invention may be random, graft, or block copolymers. The molecular weight of the interpolymers may be from about 5000 to about 10,000,000. Preferably, to promote surface activity of the stain resistant fluoropolymer, the molecular weight of the interpolymer should be from about 5000 to 100,000 and most preferably, from about 5000 to about 50,000. The interpolymers may be organic solvent soluble, but preferably, they are water soluble or water dispersible.

The protective overcoats of the invention contain from about 15 to about 40 weight percent of the fluoro(meth) acrylate interpolymer based on the total weight of the polyurethane and the interpolymer. At interpolymer concentrations less than about 15 weight percent the overcoat has greatly diminished resistance to stain and at concentrations greater than about 40 weight percent the physical properties of the overcoat, such as scratch and abrasion resistance, are adversely affected.

The abrasion resistance of the protective overcoats of the invention can be improved by adding a crosslinking agent that reacts with functional groups present in the polyurethane and/or the interpolymer, for example, carboxyl groups. Crosslinking agents such as aziridines, carbodiimides, epoxies, and the like are suitable for this purpose. The crosslinking agent can be used at about 0.5 to about 30 weight percent based on the total dry weight of the protective overcoat. However, a crosslinking agent concentration of about 2 to 12 weight percent based on the dry coating weight is preferred.

The stain resistant protective overcoat is preferably coated from a coating formula containing from about 0.5 to about 20.0 weight percent solids to give a dry coating weight of from about 50 to about 3000 mg/m$^2$.

A suitable lubricating agent can be included to give the stain resistant protective overcoat a coefficient of friction that ensures good transport characteristics during manufacturing and customer handling of the photographic film. Many lubricating agents can be used, including higher alcohol esters of fatty acids, higher fatty acid calcium salts, metal stearates, silicone compounds, paraffins and the like as described in U.S. Pat. Nos. 2,588,756; 3,121,060; 3,295,979; 3,042,522; and 3,489,567. For satisfactory transport characteristics, the lubricated surface should have a coefficient of friction of from 0.10 to 0.40. However, the most preferred range is 0.15 to 0.30. If the protective overcoat coefficient of friction is below 0.15, there is a significant danger that long, slit rolls of the photographic film will become unstable in storage or shipping and become telescoped or dished, a condition common to unstable film rolls. If the coefficient of friction is above 0.30 at manufacture or becomes greater than 0.30 after photographic film processing, a common condition of non-process surviving protective overcoat lubricants, the photographic film transport characteristics become poorer, particularly in some types of photographic film printers and projectors.

Aqueous dispersed lubricants are strongly preferred since lubricants, in this form, can be incorporated directly into an aqueous protective overcoat formula, thus avoiding a separately applied lubricant layer on the protective overcoat layer. The aqueous dispersed lubricants of carnauba wax, polyethylene oxide, microcrystalline wax, paraffin wax, silicones, stearates and amides work well as incorporated lubricants in the aqueous, protective overcoat. However, the aqueous dispersed lubricants of carnauba wax and stearates are preferred for their effectiveness in controlling friction at low lubricant levels and their excellent compatibility with aqueous binders.

In addition to lubricants, matting agents are important for improving the transport of the film on manufacturing, printing, processing, and projecting equipment. Also, these matting agents can reduce the potential for the protective overcoat to ferrotype when in contact with the emulsion side surface under the pressures that are typical of roll films. The term "ferrotyping" is used to describe the condition in which the backside outermost layer, when in contact with the emulsion side under pressure, as in a tightly wound roll, adheres to the emulsion side sufficiently strongly that some sticking is noticed between the backside layer and the emulsion side surface layer when they are separated. In severe cases of ferrotyping, damage to the emulsion side surface may occur when the protective topcoat and emulsion side surface layers are separated. This severe damage may have an adverse sensitometric effect on the emulsion.

The stain resistant protective overcoat of the present invention may contain matte particles. The matting agent may be silica, calcium carbonate, or other mineral oxides, glass spheres, ground polymers and high melting point waxes, and polymeric matte beads. Polymeric matte beads are preferred because of uniformity of shape and uniformity of size distribution. The matte particles should have a mean diameter size of about 0.5 to about 5 micrometers. However, preferably the matte particles have a mean diameter of from about 0.75 to about 2.5 micrometers. The matte particles can be employed at a dry coating weight of about 1 to about 100 mg/m$^2$. The preferred coating weight of the matte particles is about 1 to about 50 mg/m$^2$.

The photographic element of the present invention also includes a process surviving electrically conductive layer. The conductive layer may be present as a conductive subbing layer on either side or both sides of the support. For example, the conductive subbing layer may be used under the silver halide emulsion layer, under the stain resistant protective overcoat, or under both layers. The electrically conductive layer may also be present as a conductive overcoat for the silver halide photographic emulsion layer. In this case there may also be an electrically conductive subbing employed under the stain resistant protective overcoat so that conductive layers are present on both sides of the film. The electrically conductive layer of the invention contains an electrically conductive agent that is inherently stable toward photographic processing solutions, i.e., the electrically conductive layer is process surviving. The electrically conductive layer has a resistivity before and after film processing that is about $5\times10^{11}$ Ω/□ or less.

The preferred electrically conductive agents for use in the electrically conductive layer include;

1) electrically conductive metal-containing particles including donor-doped metal oxides, metal oxides containing oxygen deficiencies, and conductive nitrides, carbides, and bromides. Specific examples of particularly useful particles include conductive $SnO_2$, $In_2O_3$, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394,441, 4,416,963, 4,418,141, 4,431,764, 4,495,276, 4,571,361, 4,999,276, 5,122,445 and 5,368,995.

2) fibrous electrically conductive powders comprising, for example, antimony-doped tin oxide coated onto non-conductive potassium titanate whiskers as described in U.S. Pat. Nos. 4,845,369 and 5,166,666 and antimony-doped tin oxide fibers or whiskers as described in U.S. Pat. Nos. 5,719,016 and 5,0731,119.

3) the electrically conductive polyacetylenes, polythiophenes, and polypyrroles of U.S. Pat. Nos. 4,237,194, 5,370,981, and Japanese Patent Applications 2282245 and 2282248.

The above mentioned electrically conductive agents are applied with a polymeric binder. Various polymer binders may be used to form the layer such as gelatin, cellulosics, polyurethanes, polyesters, interpolymers of ethylenically unsaturated monomers such as (meth)acrylic acid and its esters, styrene and its derivatives, vinyl chloride, butadiene, and others. When the electrically conductive layer is a conductive subbing layer or overcoat for a silver halide emulsion layer it is preferable to employ gelatin as the binder in order to promote optimum adhesion to the adjacent silver halide emulsion layer.

In addition to the electrically conductive agent and the polymeric binder, the conductive layer optionally contains coating aids, biocides, dispersants, hardeners and crosslinking agents, and matte beads.

The present invention will now be described in detail with reference to specific examples, however, the present invention should not be limited to these examples.

Preparation of Stain Resistant Interpolymers of the Invention

The following monomers were used in the preparation of the stain resistant interpolymers.

FX-13 2-(N-ethylperfluorooctanesulfonamido) ethyl acrylate

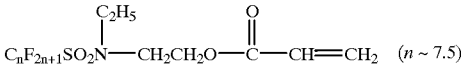

PGMA poly(ethylene glycol) methacrylate

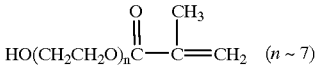

AA acrylic acid

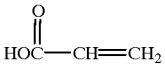

The interpolymers were prepared via free radical solution polymerization in tetrahydrofuran solvent, then neutralized with triethylamine and dispersed in deionized water. An example preparation for an interpolymer containing a fluoro acrylate (3M Fluorad™ FX-13), polyethyleneglycol methacrylate (Carbowax-550 acrylate, PGMA), and acrylic acid (AA) is given below.

Fluorad™ FX-13 (56 g), PGMA (16 g), and AA (8 g) were charged into a 1 liter round-bottom flask, along with 320 g of tetrahydrofuran and 0.5 g of AIBN initiator. The flask was swirled briefly to dissolve the monomer-initiator mixture, which was then sparged with nitrogen for 10 minutes. The flask was sealed with a rubber septum and immersed in a constant temperature water bath at 60° C. for 24 hours. The resultant polymer solution was then cooled to room temperature, neutralized by addition of 11 g of triethylamine, and finally diluted with deionized water to yield an aqueous polymer solution containing 7.7% solids. This polymer contained a weight ratio of FX-13/PGMA/AA equal to 60/30/10 and had a molecular weight of 16,000. Additional interpolymer compositions were prepared in an analogous manner and these polymers were used in the following example coating compositions.

EXAMPLE 1

A subbed polyester support was prepared by first applying a subbing terpolymer of acrylonitrile, vinylidene chloride and acrylic acid to both sides of the support before drafting and tentering so that the final coating weight was about 90 mg/m$^2$.

An electrically conductive layer consisting of the following components was prepared, the layer was applied over the terpolymer subbing layer on one side of the support at a dry coating weight of 300 mg/m$^2$.

| | |
|---|---|
| antimony-doped tin oxide (SN100D, Ishihara Sangyo Kaisha Ltd.) | 80 wt % |
| polyesterionomer binder (AQ29, Eastman Chemical Co.) | 20 wt % |

Next, a stain resistant protective overcoat of the invention was applied over the electrically conductive layer. This layer was applied at a dry coating weight of 1 g/m$^2$ and consisted of the following components.

| | |
|---|---|
| stain resistant interpolymer, FX-13/PGMA/AA = 60/30/10 | 19.5 wt % |
| Sancure 898* aqueous dispersed polyurethane (B. F. Goodrich Corp.) | 68.3 wt % |
| polyfunctional aziridine crosslinking agent (CX100, Zeneca Resins Co.) | 9.7 wt % |
| 1.5 μm polymethyl methacrylate matte beads | 2.4 wt % |
| carnauba wax (Michemlube 160, Michelman Inc.) | 0.1 wt % |

* - Sancure 898 has a tensile elongation to break equal to 210% and a Young's modulus measured at an elongation of 2% equal to 115,000 lb/in$^2$ Next, a thin gelatin adhesion promoting layer was applied over the terpolymer subbing layer on the side of the support opposite to the electrically conductive layer and protective overcoat. This gelatin adhesion promoting layer was then overcoated with a silver halide emulsion layer suitable for color motion picture print film and a conventional emulsion overcoat containing 1 g/m$^2$ of gelatin, 5 mg/m$^2$ of 2 μm polymethyl methacrylate matte beads and 9 mg/m$^2$ of polydimethyl siloxane lubricant. This photographic film was then tested for electrical resistivity and processor tar stain resistance.

Tar Stain Test

During routine film development, by-products of oxidized color developer will form brown, oily residue that may be adsorbed by the film surface and may create permanent, brown stained spots, i.e. tar.

A simulated developer tar test was performed on the samples to determine their propensity for tar/stain build-up. The test was done at 105° F. and involved smearing tar harvested from a developer tank onto the coating immersed in a developer bath followed by removal of the tar using dilute sulfuric acid. The resultant stain or tar is indicative of the propensity of the coating for tar adsorption.

Electrical Resistivity Test

Internal resistivity or "water electrode resistivity" was measured by the procedures described in R. A. Elder, "Resistivity Measurements on Buried Conductive Layers", EOS/ESD Symposium proceedings, September 1990, pages 251–254 after the film was processed in an ECP-2 motion picture film processor.

Example 1 gave an internal resistivity value of $2\times10^8$ Ω/□ after film processing, which is indicative of a highly conductive layer that should provide excellent antistatic performance. In addition, the protective overcoat of Example 1 had excellent resistance to tar stain. By contrast, a comparative sample C1 prepared in an analogous manner to Example 1 except that the protective overcoat contained only polyurethane, matte beads, polyfunctional aziridine, and carnauba wax (i.e., no stain resistant interpolymer was added) gave an internal resistivity value of $1.6\times10^8$ Ω/□ after film processing, but, had a dark tar stain.

Comparative sample C2 was prepared as per Example 1 except that the electrically conductive layer contained a conductive agent that is not inherently stable to photographic processing solutions. A vanadium pentoxide conductive agent that is known to have its conductive properties affected by contact with photographic processing solutions (see for example, U.S. Pat. Nos. 5,006,451 and 5,597,681) was used in an electrically layer that was applied at a dry coating weight of 8 mg/m$^2$ and consisted of the following components.

| | |
|---|---|
| Ag-doped vanadium pentoxide | 50 wt % |
| acrylonitrile/vinylidene chloride/acrylic acid terpolymer latex | 50 wt % |

This electrically conductive layer was overcoated with the protective overcoat composition of Example 1. The other side of the support material contained the gelatin adhesion promoting layer, silver halide emulsion layer, and emulsion protective overcoat described in Example 1. This sample had excellent resistance to tar stain, but, gave an internal resistivity value of greater than $10^{13}$ Ω/□ after film processing, which is indicative of very poor antistatic performance.

EXAMPLE 2

A polyester support with terpolymer subbing layers on both sides was prepared as per Example 1. The protective overcoat composition of Example 1 was applied over the terpolymer subbing layer on one side of the support. On the side opposite to the protective overcoat, an electrically conductive layer consisting of the following components was applied onto the terpolymer subbing layer. The dry coating weight for the electrically conductive layer was 300 mg/m$^2$.

| | |
|---|---|
| antimony-doped tin oxide (SN100D, Ishihara Sangyo Kaisha Ltd.) | 80 wt % |
| gelatin | 19.7 wt % |
| dihydroxy dioxane gelatin hardener | 0.3 wt % |

The electrically conductive layer was overcoat with a silver halide emulsion layer suitable for color motion picture print film and a conventional emulsion overcoat containing 1 g/m$^2$ of gelatin, 5 mg/m$^2$ of 2 μm polymethyl methacrylate matte beads and 9 mg/m$^2$ of polydimethyl siloxane lubricant. This photographic film gave an internal resistivity value of $3\times10^8$ Ω/□ after film processing and had excellent resistance to tar stain.

EXAMPLES 3 TO 7 COMPARATIVE SAMPLES C3 TO C5

Other protective overcoat compositions of the invention were applied over an electrically conductive layer and evaluated for tar stain resistance. The description of the coating compositions and the results obtained are given in the following table. The protective overcoats were applied at a dry coating weight of 900 mg/m$^2$.

| Coating | Composition of interpolymer, weight ratio of FX-13/PGMA/iBMA/AA | Weight ratio of interpolymer/ Sancure 898 polyurethane | Tar stain resistance |
|---|---|---|---|
| Example 3 | 80/10/0/10 | 22/78 | excellent |
| Example 4 | 70/20/0/10 | 22/78 | excellent |
| Example 5 | 50/40/0/10 | 22/78 | excellent |
| Example 6 | 40/50/0/10 | 22/78 | excellent |
| Example 7 | 72/9/9/10 | 22/78 | excellent |
| Comparative Sample C3 | 50/40/0/10 | 11/89 | poor |
| Comparative Sample C4 | 36/9/45/10 | 22/78 | poor |
| Comparative Sample C5 | 18/18/54/10 | 22/78 | poor |

As can be seen in the above results, only protective overcoat compositions of the invention provide excellent resistance to processor tar stain. Overcoats that contain too little of the fluoro(meth)acrylate interpolymer (Comparative Sample C3) or those that contain an interpolymer having greater than 40 weight % of iBMA provide poor resistance to tar stain.

The invention has been described in detail with particular reference to certain preferred embodiments thereof, but it will be understood that variations and modifications can be effected within the spirit and scope of the invention.

What is claimed is:

1. A photographic element comprising:

a support;

at least one silver halide emulsion layer superposed on said support;

at least one electrically conductive layer superposed on said support, said electrically conductive layer comprising an electrically conductive agent and a binder; and as an outermost layer a protective overcoat superposed on a side opposite the at least one silver halide emulsion layer, said protective overcoat comprising a polyurethane having a tensile elongation to break of at least 50% and a Young's modulus measured at 2% elongation of at least 50,000 lb/in$^2$ and an interpolymer comprising repeating units of A and B wherein A comprises a fluorine containing acrylate or a fluorine containing methacrylate monomer and B comprises an ethylenically unsaturated monomer containing hydratable groups and the concentration of interpolymer is between 15 and 40 weight percent of the polyurethane and the interpolymer.

2. The photographic element of claim 1 wherein the support comprises cellulose nitrate film, cellulose acetate film, poly(vinyl acetal) film, polystyrene film, poly(ethylene terephthalate) film, poly(ethylene naphthalate) film, polycarbonate film, glass, metal or paper.

3. The photographic element of claim 1 wherein the repeating unit A is derived from a fluoro(meth)acrylate represented by the following formula:

$$(R_f)_pLOCOCR{=}CH_2$$

where the $R_f$ substituent is a monovalent, fluorinated, aliphatic organic radical having at least one carbon atom and as many as 20 carbon atoms, p is 1 or 2 and L is a bond or hydrocarbyl radical linkage group containing from 1 to 12 carbon atoms and R is either H or methyl.

4. The photographic element of claim 3 wherein the fluoro(meth)acrylate monomer contains at least 30 weight percent fluorine.

5. The photographic element of claim 1 wherein the repeating unit B is derived from monomers represented by the following formula:

$$CH_2{=}CRL(COOH)_x$$

where R is H, methyl, ethyl, carboxy, carboxymethyl, or cyano, L is a bond or hydrocarbyl radical linkage group containing from 1 to 12 carbon atoms, X is equal to 1 or 2.

6. The photographic element of claim 1 wherein the interpolymer comprises from 10 to 90 weight % of units A and from 10 to 90 weight % of units B.

7. The photographic element of claim 1 wherein the interpolymer comprise a molecular weight of from about 5000 to about 10,000,000.

8. The photographic element of claim 1 wherein the electrically conductive agent comprises electrically conductive metal-containing particles, fibrous electrically conductive powders, electrically conductive polyacetylenes, electrically conductive polythiophenes or electrically conductive polypyrroles.

9. The photographic element of claim 1 wherein the binder of the electrically conductive comprises gelatin, cellulosics, polyurethanes, polyesters, interpolymers of ethylenically unsaturated monomers, styrene, vinyl chloride or butadiene.

10. The photographic element of claim 1 wherein the electrically conductive layer further comprises coating aids, biocides, dispersants, hardeners, crosslinking agents or matte beads.

11. The photographic element of claim 1 wherein the electrically conductive layer is superposed on the side of the at least one silver halide emulsion layer.

12. The photographic element of claim 1 wherein the electrically conductive layer is superposed on the side opposite the at least one silver halide emulsion layer.

13. The photographic element of claim 1 wherein the protective overcoat further comprises crosslinking agents, lubricating agents or matting agents.

14. The photographic element of claim 1 wherein the interpolymer comprises from about 15 to about 40 weight percent based on a total weight of the polyurethane and the interpolymer.

* * * * *